US011269284B2

(12) United States Patent
Jeran

(10) Patent No.: US 11,269,284 B2
(45) Date of Patent: Mar. 8, 2022

(54) PATTERN DISCHARGE TO PHOTOCONDUCTOR

(71) Applicant: Hewlett-Packard Development Company, L.P., Spring, TX (US)

(72) Inventor: Paul Jeran, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 31 days.

(21) Appl. No.: 16/499,048

(22) PCT Filed: Apr. 27, 2017

(86) PCT No.: PCT/US2017/029795
§ 371 (c)(1),
(2) Date: Sep. 27, 2019

(87) PCT Pub. No.: WO2018/199950
PCT Pub. Date: Nov. 1, 2018

(65) Prior Publication Data

US 2021/0109474 A1 Apr. 15, 2021

(51) Int. Cl.

| | |
|---|---|
| ***G03G 21/04*** | (2006.01) |
| ***G03G 15/043*** | (2006.01) |
| ***G03G 15/045*** | (2006.01) |

(52) U.S. Cl.
CPC ..... *G03G 21/043* (2013.01); *G03G 15/043* (2013.01); *G03G 15/045* (2013.01); *G03G 2215/047* (2013.01)

(58) Field of Classification Search
CPC .. G03G 21/043; G03G 15/043; G03G 15/045; G03G 2215/047
See application file for complete search history.

(56) References Cited

U.S. PATENT DOCUMENTS

| | | | |
|---|---|---|---|
| 4,679,927 | A | 7/1987 | Sogo et al. |
| 4,888,616 | A | 12/1989 | Nanamura et al. |
| 5,394,232 | A | 2/1995 | Tamura et al. |
| 7,228,088 | B2 | 6/2007 | Shimmura |
| 7,340,189 | B2 | 3/2008 | Itagaki |
| 7,373,097 | B2 | 5/2008 | Ehara |
| 8,328,307 | B2 | 12/2012 | VanKouwenberg |
| 8,706,009 | B2 | 4/2014 | Endoh |
| 9,201,381 | B2 | 12/2015 | Nakai |

(Continued)

FOREIGN PATENT DOCUMENTS

| | | |
|---|---|---|
| CN | 102243455 | 11/2011 |
| CN | 105843007 | 8/2016 |

(Continued)

OTHER PUBLICATIONS

Josiah M., et al, Cartridge Printing Theory, Feb. 4, 2013, http://www.uninetimaging.com/~21 pages.

*Primary Examiner* — Ryan D Walsh
(74) *Attorney, Agent, or Firm* — HP Inc. Patent Department

(57) ABSTRACT

Examples disclosed herein relate to an imaging device. The imaging device to include a discharge member to discharge a first pattern on a photoconductor; and a writing engine to control the discharge member to discharge a second pattern to the photoconductor to obscure any latent pattern formed from the first pattern remaining on the photoconductor.

20 Claims, 7 Drawing Sheets

(56) References Cited

U.S. PATENT DOCUMENTS

| | | | | |
|---|---|---|---|---|
| 2006/0153586 | A1* | 7/2006 | Ishibashi | G03G 15/556 399/79 |
| 2007/0048011 | A1* | 3/2007 | Okubo | G03G 15/1605 399/128 |
| 2007/0147864 | A1 | 6/2007 | Markovics | |
| 2008/0145082 | A1* | 6/2008 | Furumizu | G03G 15/04 399/66 |
| 2016/0050339 | A1 | 2/2016 | Tanaka | |
| 2016/0179029 | A1* | 6/2016 | Shibuya | G03G 15/043 399/51 |
| 2016/0342107 | A1 | 11/2016 | Yedid Am | |
| 2018/0335713 | A1* | 11/2018 | Miyamoto | G03G 15/0283 |

FOREIGN PATENT DOCUMENTS

| | | | | |
|---|---|---|---|---|
| EP | 0511844 | | 11/1992 | |
| GB | 2007157 | | 5/1979 | |
| JP | 6120469 | | 1/1986 | |
| JP | H0746240 | B2 * | 5/1995 | G03G 15/50 |
| WO | WO-2015041368 | A1 * | 3/2015 | G03G 15/043 |

* cited by examiner

PATTERN DISCHARGE TO PHOTOCONDUCTOR

BACKGROUND

Imaging devices—including printers, copiers, facsimile machines, multifunction printers, all-in-one devices, or other devices—convert electronic data into physical objects (e.g., printed documents, printed photographs, etc.). In some examples, imaging devices may be used to produce physical objects containing sensitive information. In such examples, various security measures may be implemented to protect the sensitive information. For example, a security measure may seek to ensure an authorized recipient receives the physical object.

BRIEF DESCRIPTION OF THE DRAWINGS

The following detailed description references the drawings, wherein.

DETAILED DESCRIPTION

Figure 1:
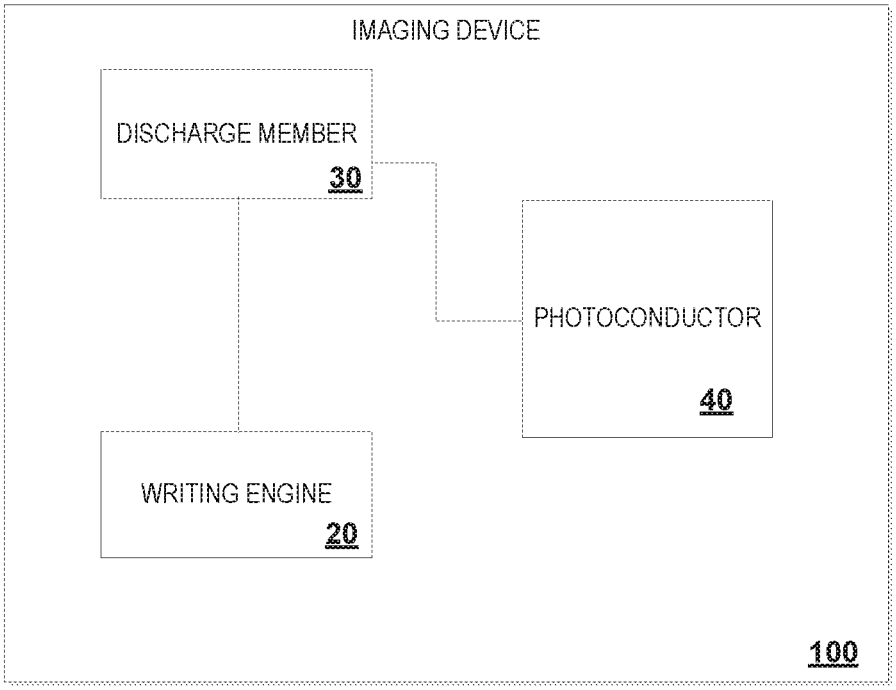
FIG. 1 is a schematic block diagram that illustrates some components of an imaging device according to an example.

The security of a job has become an important consideration for customers purchasing imaging devices. As used herein, a "job" refers to a set of instructions to produce a physical object based on electronic data, such as a printed document, a printed photograph, etc. A number of security features have been implemented in imaging devices to increase the security of a job. Some imaging devices include components that may maintain a latent image of job.

In examples, a laser printer or press may include a photosensitive element or a photoconductive element (e.g., a drum, a plate, etc.) which may retain a latent image of a job. In such an example, the photosensitive element or photoconductive element (hereinafter, a "photoconductor") may receive a negative charge. A discharging member may selectively discharge or apply a pattern on the photoconductor corresponding to a job. The photoconductor may selectively collect electrically charged particles and transfer the charged particles to a medium. In some examples, the charged particles may be a solid, such as a powdered toner or powdered ink. In other examples, the charged particles may be a fluid such as a fluid toner or fluid ink. In some examples of an imaging device, the medium may be in contact with the photoconductor to receive the charged particles. In other examples, an imaging device may deposit the charged particles onto another element (e.g., a transfer belt, etc.) for transfer to the medium. The medium may then be heated to fuse the charged particles to the medium (for example via a fuser). A number of cleaning mechanisms have been implemented into imaging devices to remove latent patterns from the photoconductor, such as, charge providing elements, blades, wipers, etc. However, it is challenging to ensure the latent image is removed to a point where it is unrecoverable.

To address these issues, in the examples described herein, an imaging device is described in which a pattern or a write pattern may be written to the photoconductor to obscure or render unrecoverable a latent pattern formed from a job. In this manner, examples described herein may reduce the security risk of a latent image remaining on a component of the imaging device. As such, the pattern may obscure an imaging pattern of a job increasing the security of jobs in an imaging device.

In some examples, an imaging device, includes a discharge member to discharge a first pattern on a photoconductor and a writing engine to control the discharge member to discharge a second pattern to the photoconductor to obscure any latent pattern formed from the first pattern remaining on the photoconductor. In some examples, the first pattern may be an imaging pattern. As used herein, the term "imaging pattern" refers to a pattern corresponding to raster line(s) or scan line(s) of a job processed by an imaging device. A job may result in one or more raster line(s) or scan line(s) being written or projected to the photoconductor. As used herein, a "raster line" or "scan lines" refers to a strip of one or more dots representing data to be printed.

As shown herein, example imaging devices may comprise engines, where such engines may be any combination of hardware and programming to implement the functionalities of the respective engines. In some examples described herein, the combinations of hardware and programming may be implemented in a number of different ways. For example, the programming for the engines may be processor executable instructions stored on a non-transitory machine-readable storage medium and the hardware for the engines may include a processing resource to process and execute those instructions.

In some examples, an imaging device implementing such engines may include the machine-readable storage medium storing the instructions and the processing resource to process the instructions, or the machine-readable storage medium may be separately stored and accessible by the system and the processing resource. In some examples, engines may be implemented in circuitry. Moreover, processing resources used to implement engines may comprise a processing unit (CPU), an application specific integrated circuit (ASIC), a specialized controller, and/or other such types of logical components that may be implemented for data processing.

In some examples, the first pattern may be a last pattern to be discharged to the photoconductor on a last page of a job. As used herein, the "last page" of a job refers to an end portion of an imaging pattern corresponding to the job. In some examples, the last page may be a portion of a printed page or the whole printed document. In some examples, the imaging pattern may be discharged or applied to the photoconductor after a certain time from the discharge of the first pattern.

In some examples, the photoconductor may be a photosensitive element. In examples, the photoconductor may be at least one of a drum, a plate, and a belt. In some examples, the discharge member is at least one of a light source or charge roller.

In some examples, a method to obscure an imaging pattern on a drum, includes determining if the imaging pattern has been written on the drum; and determining if a security operation is to be performed when the imaging pattern has been written on the drum. The method further includes acquiring a latent image reduction parameter when the security operation is to be performed; and writing a pattern to the drum according to the latent image reduction parameter, the pattern to obscure any latent pattern remaining from the imaging pattern.

In some examples, an imaging device may include a drum to receive a discharge pattern and a charged particle to be attracted to the discharge pattern; a discharge member to apply the discharge pattern to the drum; a security parameter engine to store latent image reduction parameters; and a writing engine to control the discharge member to apply a pattern to the drum to obscure any latent pattern formed from the discharge pattern remaining on the drum according to the latent image reduction parameter.

In the following discussion and in the claims, the term "couple" or "couples" is intended to include suitable indirect and/or direct connections. Thus, if a first component is described as being coupled to a second component, that coupling may, for example, be: (1) through a direct electrical or mechanical connection, (2) through an indirect electrical or mechanical connection via other devices and connections, (3) through an optical electrical connection, (4) through a wireless electrical connection, and/or (5) another suitable coupling. In contrast, the term "connect" or "connects" is intended to include direct mechanical and/or electrical connections.

Turning now to the figures, and particularly to FIG. 1, this figure provides a block diagram that illustrates some components of an example imaging device 100. Imaging device 100 includes a writing engine 20, a discharge member 30, and a photoconductor 40.

In examples, photoconductor 40 may be any element to receive a charge. In examples, the photoconductor 40 may be a drum, a plate, or a belt to receive a charge. In examples, photoconductor 40 may be a photosensitive element. In examples, photoconductor 40 may be an organic photoconductor made of an organic monomer such an N-vinylcarbazole. In examples, photoconductor 40 may receive a negative charge. In other examples, photoconductor 40 may receive a positive charge. In some examples, photoconductor 40 may be removeably coupled to imaging device 100. In such an example, photoconductor 40 may be disposed in a separate component to be coupled to imaging device 100. For example, photoconductor 40 may be disposed in a print cartridge to be coupled to imaging device 100. In other examples, photoconductor 40 may be disposed inside a chassis of imaging device 100.

In examples, discharge member 30 may be a device to change a pattern of a charge on photoconductor 40. In some examples, photoconductor 40 may receive a uniform charge on a portion of an outer surface of photoconductor 40. For examples, photoconductor 40 may receive a uniform charge from a charge roller connected to a portion of the outer surface of photoconductor 40. In such examples, discharge member 30 may discharge a pattern from the uniform charge provided to photoconductor 40. In other words, discharge member 30 may write or apply a pattern onto photoconductor 40. As used herein, the term "write" refers to changing a charge pattern.

In examples, discharge member 30 may be a light source or a charge roller. For example, discharge member 30 may include a light source to directly or indirectly project a pattern on to photoconductor 40. In such an example, the light source may be a laser or a light emitting diode (LED). In such examples, discharge member 30 may include any number of optical elements to direct the light from the light source to photoconductor 40. For examples, discharge member 30 may include lens and/or mirrors to guide a charge pattern from the light source to photoconductor 40. In another example, discharge member 30 may be a roller to provide a charge or charge roller connected to photoconductor 40. In such an example, discharge member 30 may directly apply a charge to surface of photoconductor 40 connected thereto. In examples, if photoconductor 40 is to receive a negative charge, discharge member 30 may change a pattern on photoconductor 40 by providing a positively charged pattern to photoconductor 40 to selectively discharge photoconductor 40. In other examples, if photoconductor 40 is to receive a positive charge, discharge member 30 may change a pattern on photoconductor 40 by providing a negatively charged pattern to photoconductor 40 to selectively discharge photoconductor 40.

In examples, writing engine 20 may be a device to control discharge member 30 to change a pattern of the charge on photoconductor 40. In other words, writing engine 20 may control discharge member 30 to write a pattern to photoconductor 40. In examples, writing engine 20 may acquire an imaging pattern corresponding to a job being processed by the imaging device 100. In operation, writing engine 20 may write the imaging pattern to photoconductor 40 by controlling discharge member 30 to provide the raster line(s) or scan lines(s) of the imaging pattern to the photoconductor 40.

In examples, writing engine 20 may determine whether a security operation is to be performed by imaging device 100. As used herein, the term "security operation" refers to an operation to remove or reduce a latent image from a photosensitive element. For example, writing engine 20 may determine a security operation is to be performed when an imaging pattern is determined to be a secure job. As used herein, the term "secure job" refers to a job to be processed with a security operation. In examples, a security operation may be an operation to write a pattern to a photoconductor to obscure or render unintelligible or unrecoverable a latent image thereon. In an example, imaging device 100 may acquire instructions to perform a secure job as part of the job. In other examples, imaging device 100 may acquire instructions to perform a security operation through a user interface coupled to the imaging device (such as a touch-display, a keyboard, a button, a switch, etc.). In such an example, imaging device 100 may passively acquire (i.e., receive) instructions to perform a security operation. In other examples, imaging device 100 may actively acquire (i.e., retrieve) instructions to perform a security operation. In an example, writing engine 20 may determine to perform a security operation according to a variety of factors related to the job. For examples, writing engine 20 may determine to perform a security operation if a certain duration of time has elapsed since an imaging pattern was processed without another imaging pattern being received for processing. In other words, writing engine 20 may determine to perform a security operation after a certain time from discharge of the imaging pattern. For example, writing engine 20 may determine to perform a security operation if more than 30 seconds has elapsed from discharge of an imaging pattern to photoconductor 40. In another example, writing engine 20 may determine to perform a security operation at a certain time (e.g., at the end of the workday or a shift).

In examples, if writing engine 20 determines to perform a security operation, writing engine 20 may control discharge member 30 to discharge a pattern to photoconductor 40 to obscure any latent pattern thereon. As used herein, a "pattern" or a "write pattern" refers to a pattern provided to photoconductor 40 to obscure any latent pattern thereon. In examples, the pattern may be arbitrary. In examples, the pattern may be composed of dots. In such examples, the pattern of dots may be random. In other such examples, the pattern of dots may be continuous. In examples, the pattern of dots may be a specific pattern to obscure the raster lines of the imaging pattern. In such examples, the specific pattern may be determined by the imaging device 100. In other examples, the specific pattern may be determined by another device and acquired by the imaging device 100. In such an example, the specific pattern may be acquired as part of the job or may be acquired separately from the job by imaging device 100.

In operation, in FIG. 1, imaging device 100 may receive a job to process and writing engine 20 may determine the job is a secure job. In such examples, writing engine 20 may control discharge member 30 to discharge a pattern to photoconductor 40. In an example, the pattern may obscure or render unintelligible or unrecoverable a latent pattern on photoconductor 40 remaining from the received job. For example, the pattern may be a random pattern to render a latent pattern unintelligible. In other examples, the pattern may be a continuous pattern, such as a series of dots and breaks there between, which may obscure a latent pattern on photoconductor 40. In yet another example, the pattern may be a specific pattern determined to obscure or render unintelligible or unrecoverable the last imaging pattern applied to photoconductor 40. In such an example, the last imaging pattern applied to photoconductor 40 may be the last page of a job. In another such example, the last imaging pattern may be the entire imaging pattern of a job.

Figure 2:
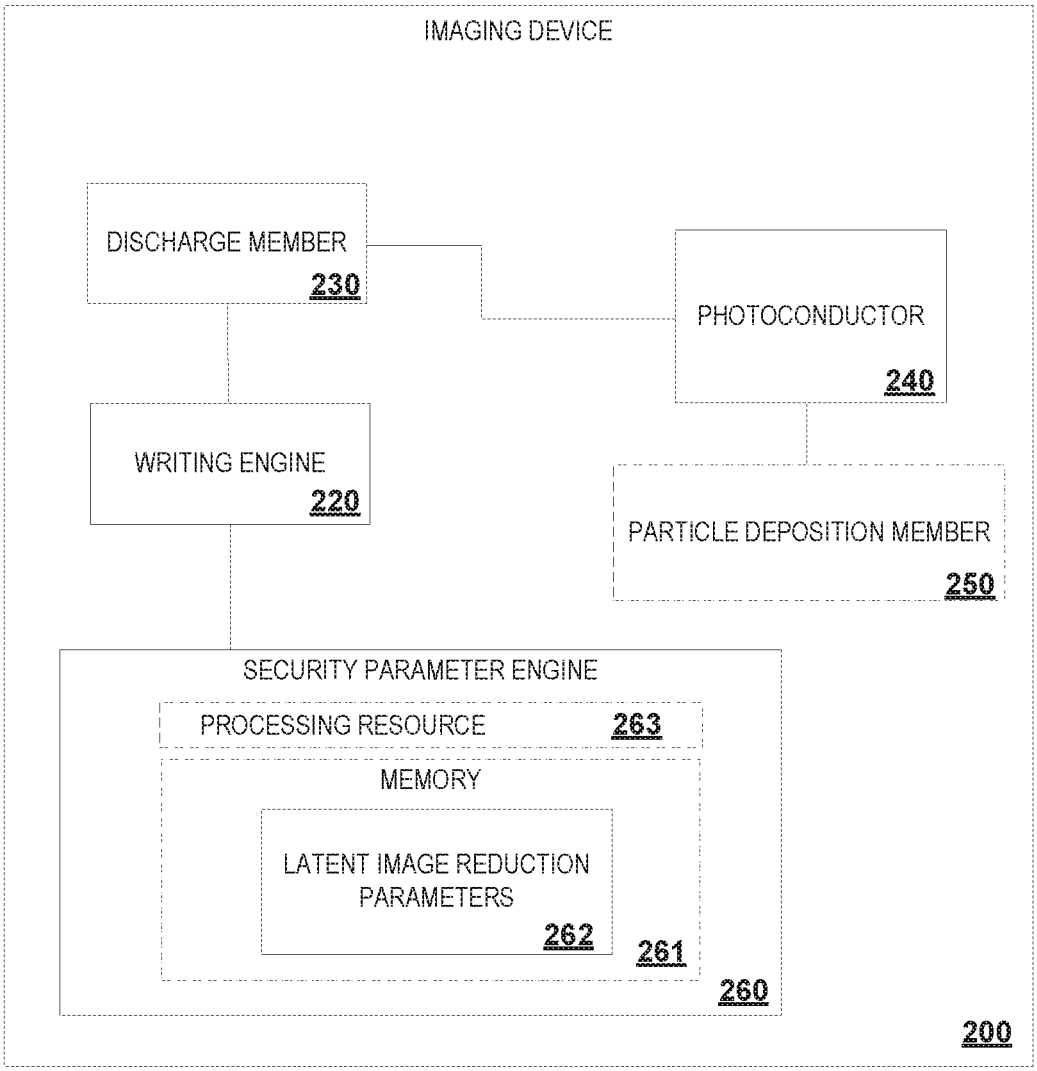
FIG. 2 is a schematic block diagram that illustrates some components of an imaging device according to an example.
Figure 3A:
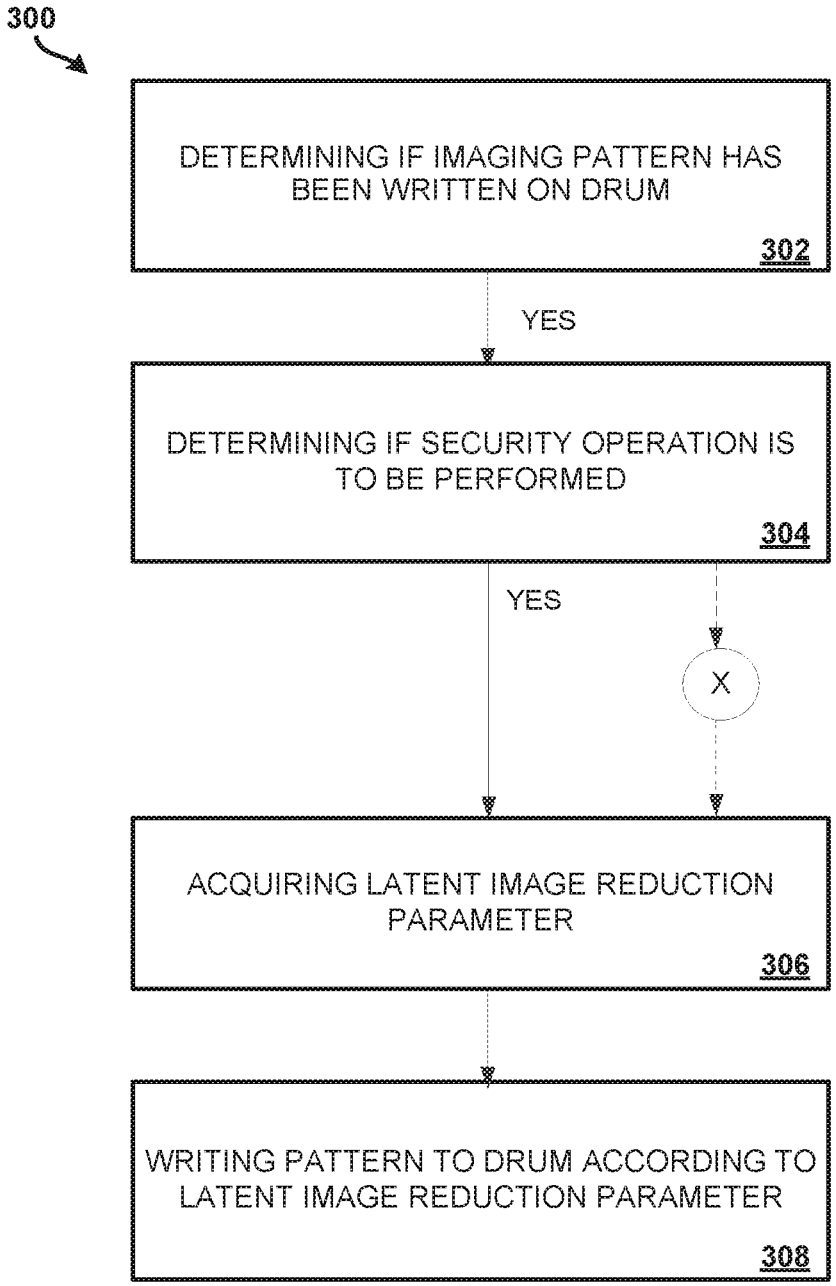
FIGS. 3A-3D are flowcharts that illustrates an example sequence of operations that may be performed by an example imaging device.
Figure 3B:
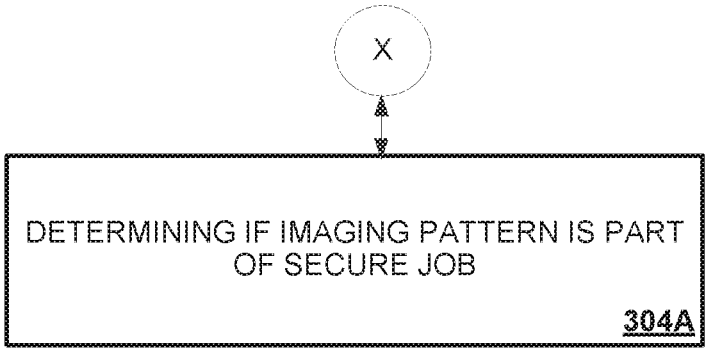
Figure 3C:
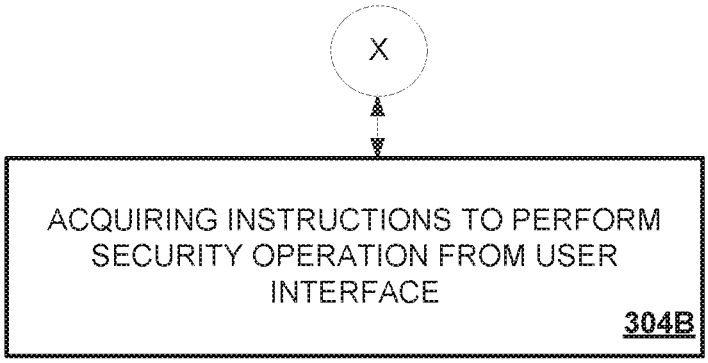
Figure 3D:
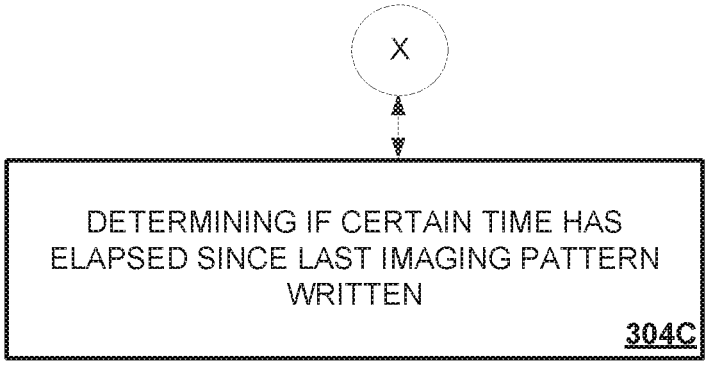

FIG. 2 is a schematic block diagram that illustrates some components of an imaging device 200. Imaging device 200 includes a writing engine 220, a discharge member 230, a photoconductor 240, a particle deposition member 250, and a security parameter engine 260. In examples, writing engine 220 may be substantially similar to writing engine 20 described above with respect to FIG. 1; redundant descriptions of writing engine 220 will be omitted. In examples, discharge member 230 may be substantially similar to discharge member 30 described above with respect to FIG. 1; redundant descriptions of discharge member 230 will be omitted. In examples, photoconductor 240 may be substantially similar to photoconductor 40 described above with respect to FIG. 1; redundant descriptions of photoconductor 240 will be omitted.

In examples, particle deposition member 250 may be a component to transfer charged particles to photoconductor 240. In examples, particle deposition member 250 may be a roller. In such examples, particle deposition member 250 may be coupled to a receptacle to receive charged particles. For example, particle deposition member 250 may be disposed at least partially in the receptacle to collect charged particles disposed therein. In examples, charged particles may include ink, toner, plastic, polymer, powdered metal, alloy and the like. In examples, the receptacle may be a cartridge to store a deposition material including charged particles. In one example, the cartridge may be an ink cartridge that contains liquid ink for use with an inkjet printer. In another example, the cartridge may be a toner cartridge that contains dry toner powder for use with a laser printer.

In examples, security parameter engine 260 may be an engine to store latent image reduction parameters 262. In examples, security parameter engine 260 may include a memory 261 to store latent image reduction parameters 262 and a processing resource 263. In examples, memory 261 may be any non-transitory electronic, magnetic, optical, or other physical storage device. For examples, memory 261 may be a random access memory (RAM), an electrically erasable programmable read-only memory (EEPROM), a read-only memory (ROM), flash memory, a storage drive or the like. Although depicted as a separate engine, security parameter engine 260 may be part of writing engine 220.

In examples, latent image reduction parameters 262 may indicate at least one of a duration of a write pattern, a number of write pattern(s), an amplitude of the write pattern, and a power level of a write pattern to be applied to photoconductor 240. In such examples, the security parameter engine 260 may determine one or more of the latent image reduction parameters 262 according to various parameters of imaging device 200. For example, the security parameter engine 260 may determine the number of write patterns to be provided to photoconductor 240 according various characteristics of the job processed by imaging device 200, such as a dot density of raster lines(s), number of raster lines, color of the raster lines, etc. In another example, security parameter engine 260 may determine the duration of a write pattern to be applied to photoconductor 240 based on a dot density of the raster line(s) of the job. In yet another example, security parameter engine 260 may determine the amplitude of the write pattern based on the number of raster lines in the job. In other examples, security parameter engine 260 may determine the power level of the write pattern based on a condition of photoconductor 240.

In examples, security parameter engine 260 may provide the latent image reduction parameters 262 to writing engine 220. In such examples, writing engine 220 may control discharge member 230 to discharge or apply a write pattern to photoconductor 240 according to the latent image reduction parameters 262. For example, in a laser printer, writing engine 220 may control a laser to write or project the write pattern to a photoconductive drum according to latent image parameters 262. In other words, in such an example, writing engine 220 may control a laser to discharge the write pattern to the photoconductor (i.e., the photoconductive drum) according to latent image parameters 262. In such an example, writing engine 220 may control the laser to write or project more than one write pattern to the photoconductive drum according to latent image parameters 262. In another such example, writing engine 220 may control the laser to write or project a write pattern at a specific amplitude according to latent image parameters 262. In yet another such example, writing engine 220 may control the laser to write or project the write pattern for a certain duration of time or number of charge and discharge cycles according to latent image parameters 262. In another example, in a laser printer with a charge roller, the writing engine 220 may control the charge roller to apply a write pattern at a certain power level or number of charge and discharge cycles according to latent image parameters 262.

In operation, in FIG. 2, imaging device 200 may receive a job to process and writing engine 220 may determine whether a security operation should be performed. In examples, if a security operation is to be performed, security parameter engine 260 may provide writing engine 220 with latent image reduction parameters 262. In such an example, writing engine 220 may control discharge member 230 to discharge, write, or project a write pattern to photoconductor 240 according to latent image reduction parameters 262.

FIGS. 3A-3D provides flowcharts that provide an example sequence of operations that may be performed by an example imaging device and/or a processing resource thereof to perform example processes and methods. In some examples, the operations included in the flowchart may be embodied in an engine (such as the example engine 220 or engine 260 of FIG. 2) in the form of instructions that may be executable by a processing resource to cause an example imaging device and/or a control engine thereof to perform the operations corresponding to the instructions. Additionally, the examples provided in FIGS. 3A-3D may be embodied in systems, machine-readable storage mediums, processes, and/or methods. In some examples, the example processes and/or methods disclosed in the flowcharts of FIGS. 3A-3D may be performed by one or more engines. Moreover, performance of some example operations described herein may include control of components and/or subsystems of the imaging device by a control engine thereof to cause performance of such operations. For example, writing an imaging pattern to a drum may include control of the drum by the control engine to rotate about a central axis to receive the imaging pattern.

Turning now to FIGS. 3A-3D, these figure provides a flowchart 300 that illustrates an example sequence of operations that may be performed by an example imaging device. In examples, the imaging device may determine if an imaging pattern has been written to a drum (block 302). In such examples, the drum may be a photoconductor to receive a charge. In examples, the imaging device may determine if a security operation is to be performed (block 304). In some examples, the imaging device may determine a security operation is to be performed by determining if the imaging pattern is a part of a secure job (block 304A). In other examples, the imaging device may determine a security operation is to be performed by acquiring instructions to perform a security operation from a user interface (block 304B). In another example, the imaging device may determine a security operation is to be performed by determining if a certain time has elapsed since the last job was written (block 304C). In examples, the imaging device may acquire a latent image reduction parameter (block 306). In examples, the imaging device may passively acquire (i.e., receive) the latent image reduction parameter. In other examples, the imaging device may actively acquire (i.e., retrieve) the latent image reduction parameter. The imaging device may write a pattern to the drum according to the latent imagine reduction parameter (block 308).

Figure 4:
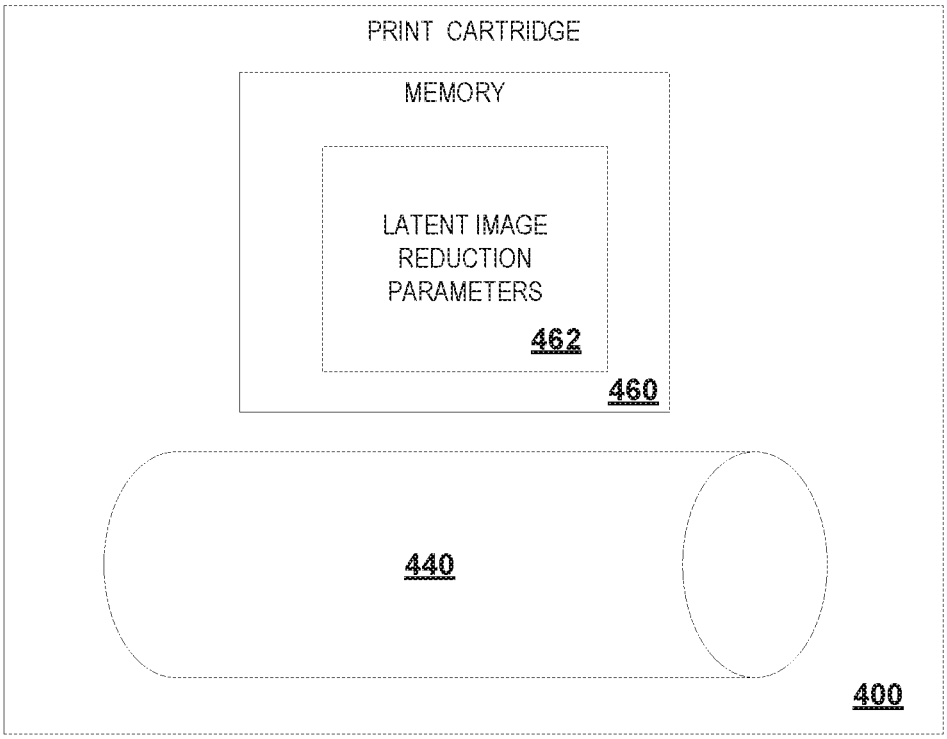
FIG. 4 is a schematic block diagram that illustrates some components of a printer cartridge according to an example.

FIG. 4 is a schematic block diagram that illustrates some components of a printer cartridge 400 according to an example. In examples, printer cartridge 400 includes a memory 460 and a photoconductor 440. The printer cartridge 400 may be any type of cartridge to store a deposition material including charged particles. Example depositing materials may include ink, toner, plastic, polymer, powdered metal, alloy and the like. In one example, the printer cartridge 400 may be an ink cartridge that contains liquid ink for use with an inkjet printer. In another example, the printer cartridge 400 may be a toner cartridge that contains dry toner powder for use with a laser printer. In yet another example, print cartridge 400 may be a three-dimensional cartridge such that print cartridge 400 may be used for three-dimensional printing.

In examples, print cartridge 400 is shown to include a memory 460 including latent image reduction parameters 462. In examples, memory 460 may be any non-transitory electronic, magnetic, optical, or other physical storage device. For examples, memory 460 may be a random access memory (RAM), an electrically erasable programmable read-only memory (EEPROM), a read-only memory (ROM), flash memory, a storage drive or the like. In examples, memory 460 may be disposed on an outer surface of print cartridge 400. In some such examples, memory 460 may be removeably coupled to the outer surface of print cartridge 400.

In examples, memory 460 is shown to store a latent image reduction parameters 462. In examples, latent image reduction parameters 462 may indicate at least one of a duration of a write pattern, a number of write pattern(s), an amplitude of the write pattern, and a power level of a write pattern to be applied to photoconductor 440. In examples, print cartridge 400 may provide latent image reduction parameters 462 to an imaging device coupled to print cartridge 400. In such examples, the imaging device may write a pattern to photoconductor 440 according to the latent image reduction parameters 462 as described above with respect to FIGS. 1-3D.

In an example, latent image reduction parameters 462 may be changed according to cartridge usage information of print cartridge 400. In such an example, an imaging device coupled to print cartridge 400 may provide cartridge usage information to print cartridge 400. In other examples, print cartridge 400 may include hardware components and/or programming to monitor photoconductor 440 and any other components of print cartridge 400 or an imaging device coupled thereto to determine cartridge usage information. As used herein "cartridge usage information" may be any data about a print cartridge which can be measured or determined. For example, cartridge usage information may include information about the movement of a photoconductor (e.g., the number of rotations competed by a photoconductive drum), the amount of a charge applied to the photoconductor, the duration of a charge applied to the photoconductor, the amount of deposition material disposed in the print cartridge, etc. In examples, print cartridge 400 may include processing resources to change latent image reduction parameters 462. In other examples, an imaging device coupled to print cartridge 400 may change latent image reduction parameters 462.

In some examples, a print cartridge includes a photosensitive element to receive an imaging pattern; and a security parameter engine to store latent image reduction parameters, the latent image reduction parameter to indicate at least one of a duration of a write pattern, a number of write pattern(s), an amplitude of the write pattern, and a power level of a write pattern, wherein the write pattern is to obscure a latent pattern formed from the imaging pattern remaining on the photosensitive element.

Figure 5:
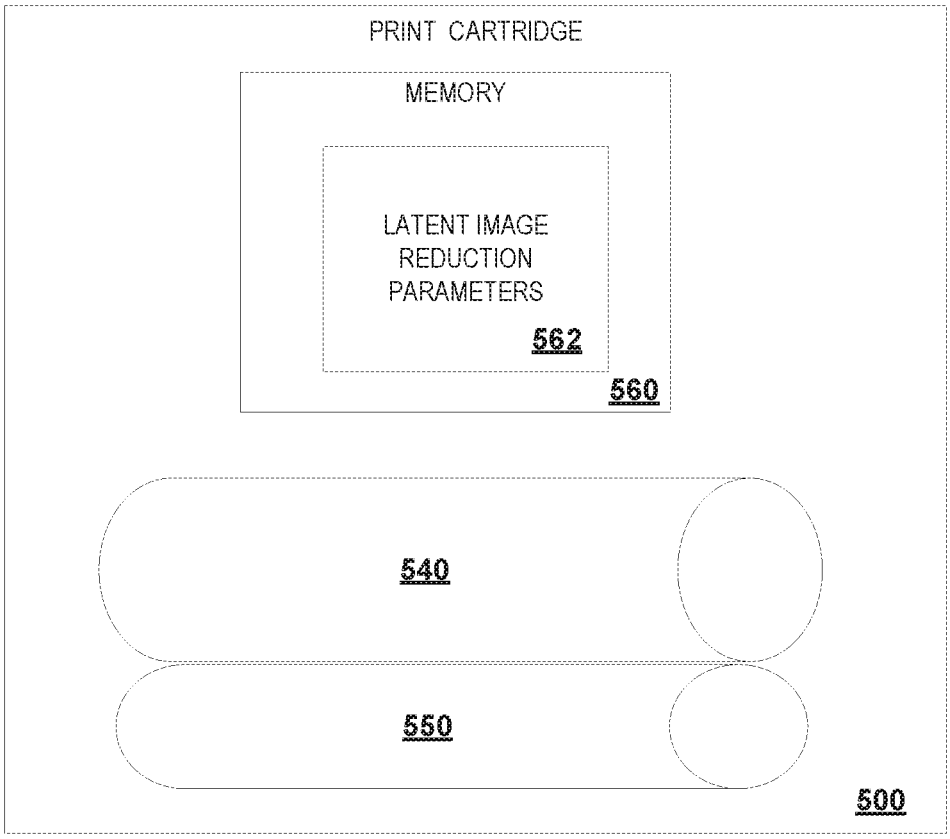
FIG. 5 is a schematic block diagram that illustrates some components of a printer cartridge according to an example.

FIG. 5 is a schematic block diagram that illustrates some components of a printer cartridge 500 according to an example. In examples, printer cartridge 500 includes a memory 560, a photoconductor 540, and a particle deposition member 550. The printer cartridge 500 may be any type of cartridge to store a deposition material including charged particles. Example depositing materials may include ink, toner, plastic, polymer, powdered metal, alloy and the like. In one example, the printer cartridge 500 may be an ink cartridge that contains liquid ink for use with an inkjet printer. In another example, the printer cartridge 500 may be a toner cartridge that contains dry toner powder for use with a laser printer. In yet another example, print cartridge 500 may be a three-dimensional cartridge such that print cartridge 500 may be used for three-dimensional printing.

In examples, particle deposition member 550 may be may be a component to transfer charged particles to photoconductor 540. In examples, particle deposition member 550 may be a roller. In such examples, particle deposition member 550 may be disposed to receive the deposition material in print cartridge 500. For example, particle deposition member 550 may be disposed at least partially in the deposition material disposed in print cartridge 500. In such an example, deposition member 550 may be coupled to the deposition material.

In examples, print cartridge 500 is shown to include a memory 560 including latent image reduction parameters 562. In examples, latent image reduction parameters 562 may indicate at least one of a duration of a write pattern, a number of write pattern(s), an amplitude of the write pattern, and a power level of a write pattern to be applied to photoconductor 540. In examples, memory 560 may be any non-transitory electronic, magnetic, optical, or other physical storage device. For examples, memory 560 may be a random access memory (RAM), an electrically erasable programmable read-only memory (EEPROM), a read-only memory (ROM), flash memory, a storage drive or the like. In examples, memory 560 may be disposed on an outer surface of print cartridge 500. In some examples, memory 560 may be removeably coupled to the outer surface of print cartridge 500.

In examples, print cartridge 500 may provide latent image reduction parameters 562 to an imaging device coupled to print cartridge 500. In such examples, the imaging device may write a pattern to photoconductor 540 according to the latent image reduction parameters 562. In examples, latent image reduction parameters 562 may be changed according to cartridge usage information of print cartridge 500. In such an example, an imaging device coupled to print cartridge 500 may provide cartridge usage information to print cartridge 500. In other examples, print cartridge 500 may include hardware components and/or programming to monitor at least one of photoconductor 540, particle deposition member 550, and any other components of print cartridge 500 or an imaging device coupled thereto to determine cartridge usage information. In examples, print cartridge 500 may include processing resources to change latent image reduction parameters 562. In other examples, an imaging device coupled to print cartridge 500 may change latent image reduction parameters 562.

In some examples, a print cartridge includes a photosensitive element to receive an imaging pattern; a particle deposition member to provide a charged particle to the photosensitive element; and a security parameter engine to store latent image reduction parameters, the latent image reduction parameter to indicate at least one of a duration of a write pattern, a number of write pattern(s), an amplitude of the write pattern, and a power level of a write pattern, wherein the write pattern is to obscure a latent pattern formed from the imaging pattern remaining on the photosensitive element.

Figure 6:
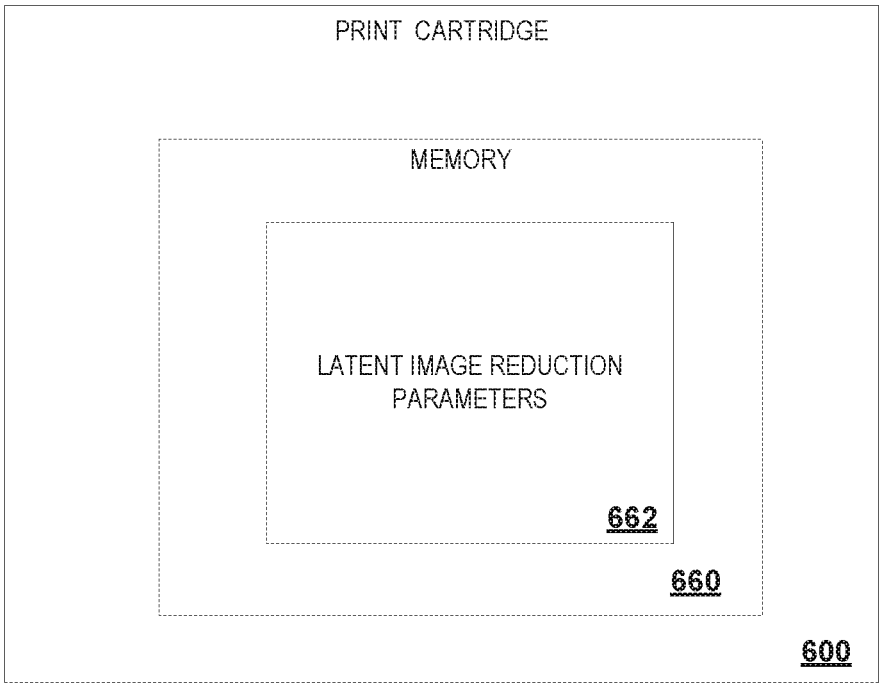
FIG. 6 is a schematic block diagram that illustrates some components of a printer cartridge according to an example.

FIG. 6 is a schematic block diagram that illustrates some components of a printer cartridge 600 according to an example. In examples, printer cartridge 600 includes a security parameter engine 660 to store latent image reduction parameters 662. The printer cartridge 600 may be any type of cartridge to store a deposition material including charged particles. Example depositing materials may include ink, toner, plastic, polymer, powdered metal, alloy and the like. In one example, the printer cartridge 600 may be an ink cartridge that contains liquid ink for use with an inkjet printer. In another example, the printer cartridge 600 may be a toner cartridge that contains dry toner powder for use with a laser printer. In yet another example, print cartridge 600 may be a three-dimensional cartridge such that print cartridge 600 may be used for three-dimensional printing.

In examples, security parameter engine 660 may be any combination of hardware and programming to implement the functionalities of the engine. In examples, security parameter engine 660 may be disposed on an outer surface of print cartridge 600. In some examples, security parameter engine 660 may be removeably coupled to the outer surface of print cartridge 600. In examples, security parameter engine 660 of FIG. 6 may respectively include at least the functionality and/or hardware of the memory 460 of FIG. 4 or memory 560 of FIG. 5. For examples, security parameter engine 660 may include a memory to store latent image reduction parameters 662.

In examples, print cartridge 600 may provide latent image reduction parameters 662 to an imaging device coupled to print cartridge 600. In examples, latent image reduction parameters 662 may indicate at least one of a duration of a write pattern, a number of write pattern(s), an amplitude of the write pattern, and a power level of a write pattern to be applied to a photoconductor of an imaging device coupled to print cartridge 600. In examples, the imaging device may write a pattern to a photoconductor of the imaging device according to the latent image reduction parameters 662. In examples, latent image reduction parameters 662 may be changed according to cartridge usage information of print cartridge 600. In such an example, an imaging device coupled to print cartridge 600 may provide cartridge usage information to print cartridge 600. In other examples, print cartridge 600 may include hardware components and/or programming to monitor a photoconductor of the imaging device and any other components of print cartridge 600 or an imaging device coupled thereto to determine cartridge usage information. In examples, print cartridge 600 may include processing resources to change latent image reduction parameters 662. In other examples, an imaging device coupled to print cartridge 600 may change latent image reduction parameters 662.

In some examples, a print cartridge includes a security parameter engine to store a latent image reduction parameter, the latent image reduction parameter to indicate at least a duration of a pattern to be written to a photosensitive element to obscure a latent pattern formed from an imaging pattern remaining on the photosensitive element. In some examples, the latent image reduction parameter further includes a power level of the pattern.

While certain implementations have been shown and described above, various changes in form and details may be made. For example, some features that have been described in relation to one implementation and/or process can be related to other implementations. In other words, processes, features, components, and/or properties described in relation to one implementation can be useful in other implementations. Furthermore, it should be understood that the systems, apparatuses, and methods described herein can include various combinations and/or sub-combinations of the components and/or features of the different implementations described. Thus, features described with reference to one or more implementations can be combined with other implementations described herein.

The above discussion is meant to be illustrative of the principles and various examples of the present disclosure. Numerous variations and modifications will become apparent to those skilled in the art once the above disclosure is fully appreciated. It is intended that the following claims be interpreted to embrace all such variations and modifications.

What is claimed is:

1. An imaging device, comprising:

a discharge member to discharge a first pattern on a photoconductor, the first pattern corresponding to a job that is processed by the imaging device to produce a physical object based on the first pattern; and a writing engine to control the discharge member to discharge a second pattern to the photoconductor to obscure a latent pattern formed from the first pattern remaining on the photoconductor, the second pattern corresponding to a security operation of the imaging device to obscure the latent pattern on the photoconductor, and wherein the write engine is to determine to perform the security operation including the discharge of the second pattern in response to the print job being a secure job.

2. The imaging device of claim 1, wherein the first pattern is an imaging pattern corresponding to the job, and the writing engine is to control the discharge member to discharge the second pattern to the photoconductor without the imaging device processing another job and for at least one of:

a duration of time, at a specific amplitude, and at a specific power according to a latent image reduction parameter.

3. The imaging device of claim 1, wherein the first pattern is a last pattern to be discharged to the photoconductor on a last page of the job.

4. The imaging device of claim 1, wherein the writing engine is to:

determine to discharge the second pattern to the photoconductor after a certain time from the discharge of the first pattern without another imaging pattern being received for processing; and in response to the determination, control the discharge member to discharge the second pattern.

5. The imaging device of claim 1, wherein the photoconductor is a photosensitive element, and the writing engine is to:

determine to perform the security operation including the discharge of the second pattern after the discharge of the first pattern; and in response to the determination, discharge a second pattern on the photoconductor according to a latent image reduction parameter.

6. The imaging device of claim 1, wherein the photoconductor is at least one of a drum, a plate, and a belt.

7. The imaging device of claim 1, wherein the discharge member is at least one of a light source or charge roller, and the write engine is to determine to perform the security operation in response to a duration of time lapsing after the discharge of the first pattern or at a time of the day.

8. The image device of claim 1, wherein the imaging device further includes a security parameter engine to:

determine a duration of application of the second pattern based on a dot density of the job;

determine an amplitude of the second pattern based on a number of raster lines in the job; and determine a power level of the second pattern based on a condition of the photoconductor.

9. The imaging device of claim 1, wherein the writing engine is to control the discharge member to discharge the second pattern based on a latent image reduction parameter, the latent image reduction parameter being selected from:

a duration of the second pattern, an amplitude of the second pattern, and a power of the second pattern.

10. A method to obscure an imaging pattern on a drum, comprising:

determining if the imaging pattern has been written on the drum, the imaging pattern corresponding to a job that is processed by an imaging device to produce a physical object based on the imaging pattern;

determining the imaging pattern is part of the job that is a secure job;

in response to the print job being the secure job, determining to perform a security operation in response to determining the imaging pattern has been written on the drum;

acquiring a latent image reduction parameter when the security operation is to be performed; and writing a pattern to the drum according to the latent image reduction parameter, the pattern corresponding to the security operation of the imaging device and to obscure a latent pattern remaining from the imaging pattern and the processed job.

11. The method of claim 10, wherein in response to the determining the job is the secure job and determining the imaging pattern has been written on the drum, acquiring the latent image reduction parameter and writing the pattern.

12. The method of claim 10, wherein determining if the security operation is to be performed includes acquiring instructions to perform the security operation from a user interface, and writing the pattern to the drum for a duration of time or a number of charge and discharge cycles according to the latent image reduction parameter.

13. The method of claim 10, wherein determining if the security operation is to be performed includes determining if a certain time has elapsed since the imaging pattern was written on the drum without another imaging pattern being received for processing.

14. The method of claim 10, wherein writing the pattern to the drum is in response to the job being processed by the imaging device and determining the security operation is to be performed.

15. The method of claim 10, further including writing the pattern to the drum according to the latent image reduction parameter to perform the security operation and without executing another job.

16. An imaging device, comprising:

a drum to receive a discharge pattern and a charged particle to be attracted to the discharge pattern, the discharge pattern corresponding to a job that is processed by the imaging device to produce a physical object based on the discharge pattern;

a discharge member to apply the discharge pattern to the drum;

a security parameter engine to store latent image reduction parameters; and a writing engine to control the discharge member to:

determine to perform a security operation in response to the print job being a secure print job;

in response to the print job being the secure print job, apply a pattern to the drum to obscure a latent pattern formed from the discharge pattern remaining on the drum after the job is processed and according to the latent image reduction parameter, wherein the pattern corresponds to the security operation of the imaging device to obscure the latent pattern on the drum.

17. The imaging device of claim 16, wherein the discharge member is at least one of a light source or charge roller, and the writing engine is to determine to perform the security operation based on:

a determination that a certain time has elapsed since the application of the discharge pattern to the drum; or a time of the day that the security operation is to occur.

18. The imaging device of claim 16, wherein the charged particle is a toner, and the security parameter engine is to acquire the latent image reduction parameter from a print cartridge coupled to the imaging device.

19. The imaging device of claim 16, wherein the latent image reduction parameter is to indicate at least one of a duration of a write pattern, a number of write patterns, an amplitude of the write pattern, and a power level of a write pattern.

20. The imaging device of claim 16, wherein the security parameter engine is to determine a plurality of patterns to apply to the drum for a plurality of security operations according to print job characteristics, and to select the pattern for the security operation from the plurality of patterns based on characteristics of the job, wherein the print job characteristics are selected from:

dot density of raster lines of the job, number of the raster lines of the job, color of the raster lines of the job, and combinations thereof.

* * * * *